US007347716B2

(12) United States Patent
Oesterhaus et al.

(10) Patent No.: US 7,347,716 B2
(45) Date of Patent: Mar. 25, 2008

(54) CONNECTOR ARRANGEMENT FOR MULTI-CONDUCTOR CABLES

(75) Inventors: Jens Oesterhaus, Detmold (DE); Klaus Holterhoff, Olpe (DE); Thomas Hock, Sankt Georgen (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/799,210

(22) Filed: May 1, 2007

(65) Prior Publication Data

US 2007/0264866 A1 Nov. 15, 2007

(30) Foreign Application Priority Data

May 11, 2006 (DE) ..... 20 2006 007 510 U

(51) Int. Cl.
*H01R 4/24* (2006.01)

(52) U.S. Cl. ..... 439/404; 439/417

(58) Field of Classification Search ..... 439/404, 439/405, 417, 418, 725
See application file for complete search history.

(56) References Cited

U.S. PATENT DOCUMENTS 4,209,219 A * 6/1980 Proietto ..... 439/405
4,252,396 A 2/1981 Wilson
4,512,621 A * 4/1985 Bethurum ..... 439/395
5,076,801 A 12/1991 Schroll
5,429,526 A * 7/1995 Ann ..... 439/417
7,163,416 B2 * 1/2007 Carroll ..... 439/404

FOREIGN PATENT DOCUMENTS

DE GEB G 92 10 333.2 11/1992
DE 34 22 607 C2 2/1993
DE 44 36 829 A1 4/1996

* cited by examiner

*Primary Examiner*—Hien Vu
(74) *Attorney, Agent, or Firm*—Lawrence E Laubscher, Sr.; Lawrence E Laubscher, Jr.

(57) ABSTRACT

A connector arrangement for connecting the insulated conductors of a flat cable with a plurality of tap-off branch conductors includes a plurality of insulation-piercing contacts that extend upwardly from the horizontal upper surface of the rectangular base member of a connector housing. A horizontal actuator plate is arranged in spaced relation above the contacts to define a space for longitudinally receiving the cable. When a housing cover member is initially slidably displaced longitudinally of the base member from an open first position toward a closed second position, a first wedge arrangement displaces the actuator plate downwardly to force the cable into insulation-piercing engagement with the contacts. When the cover member is subsequently displaced to the fully closed second position, a second wedge arrangement clamps the ends of the actuator plate to the cable, thereby to provide the connector contacts with strain relief protection.

16 Claims, 10 Drawing Sheets

CONNECTOR ARRANGEMENT FOR MULTI-CONDUCTOR CABLES

BACKGROUND OF THE INVENTION

1. Field of the Invention

A connector arrangement for connecting the insulated conductors of a flat cable with a plurality of tap-off branch conductors includes a plurality of insulation-piercing contacts that extend upwardly from the horizontal upper surface of the rectangular base member of a connector housing. A horizontal actuator plate is arranged in spaced relation above the contacts to define a space for longitudinally receiving the cable. When a housing cover member is initially slidably displaced longitudinally of the base member from an open first position toward a closed second position, a first wedge arrangement displaces the actuator plate downwardly to force the cable into insulation-piercing engagement with the contacts. When the cover member is subsequently displaced to the fully closed second position, a second wedge arrangement clamps the ends of the actuator plate to the cable, thereby to provide the connector contacts with strain relief protection.

2. Description of Related Art

It is well known in the patented prior art to provide connector arrangements with insulation piercing contacts, as shown by the U.S. patent to Jaschke et al U.S. Pat. No. 6,976,866, the German Gebrauchsmuster No. G 92 10 333.2, and the German patent No. DE 44 36 829. Various types of connectors for flat cables have been proposed, as shown by the U.S. patents to Wilson U.S. Pat. No. 4,252,396, Schroll U.S. Pat. No. 5,076,801, and Ann U.S. Pat. No. 5,429,526. Nevertheless, there is a need for further development, particularly also with regard to the fast and secure wiring of flat cables with relatively many conductors.

SUMMARY OF THE INVENTION

A primary object of the present invention is to provide an improved connector arrangement for flat cables, wherein first wedge means operable during the initial longitudinal sliding displacement of the housing cover member toward an intermediate position relative to the housing base member produce downward displacement of an actuator member, thereby to press the cable into insulation-piercing engagement with electrical contacts that extend upwardly from the base member.

According to another object of the invention, second wedge means are provided that are operable during subsequent displacement of the cover member toward a final closed position relative to the base member, thereby to clamp the end portions of the actuator plate against the outer casing of the flat cable, whereby strain relief protection is provided for the electrical contacts of the connector.

A more specific object of to provide a connector arrangement of the type described above in which stabilizing plate means are provided for laterally supporting the insulation-piercing contacts that extend upwardly from the base member through slits contained in the stabilizing plate means.

According to a further object, centering wall means are provided oil the base member for longitudinally centering the cable relative to the connector base member. A vertically-displaceable cable supporting member may be provided having a contoured upper surface for supporting the flat cable during the downward displacement thereof toward the insulation-piercing contacts.

In a particularly preferred manner, at least one of the wedge arrangements for wiring the flat cable is designed especially in such a manner that it will be conceived for pushing the flat cable upon the insulation-penetrating contacts, preferably all the way to the contacting of the conductors and/or for pushing the insulation-penetrating contacts upon the flat cable.

The wedge arrangement can be used in order to implement relatively strong switching forces in a simple manner so that one can also securely contact a multi-lead cable with only a single movement.

Preferably, furthermore, at least one of the wedge arrangements is designed for actuating a device to provide for the traction relief of the cable. In this way, one can advantageously utilize the wedge actuation technique also for the traction relief task. This is done preferably in such a manner that the wedge arrangements for traction relief in each case have a wedge surface on the inside of the sliding lid upon which, during wiring, at least one wedge each will slide along for traction relief.

To prevent making wiring more difficult, the following is furthermore provided: The wedge arrangements for wiring and for traction relief are so coordinated with each other so that the traction relief is actuated only after the wiring of the flat band cable.

In a particularly preferred manner, one uses a screwdriver for contacting; this screwdriver is suitable for relatively shifting the wedges of the wedge arrangement with a strong lever force.

The wedges of the wedge arrangement are so shaped that the flat cable—possibly together with other elements (as will be described below)—will be pressed upon the insulation-penetrating contacts.

The housing is formed from several components of electrically-insulating synthetic plastic material, and includes a base component and a lid which, in turn, are made in several parts. It is possible essentially to make all parts of the base segment and the lid segment in the form of a plate so that the entire housing will have a relatively flat rectangular structure.

Preferably, a sliding lid is provided here, which is slidably guided upon a base member and which, on its inside, has wedges that cooperate with the wedges of a support plate, whereby the support plate with the cable and a receiving plate for the cable is pressed as a unit together upon the insulation-penetrating contacts. This model is compact and nevertheless allows for particularly safe and secure wiring.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
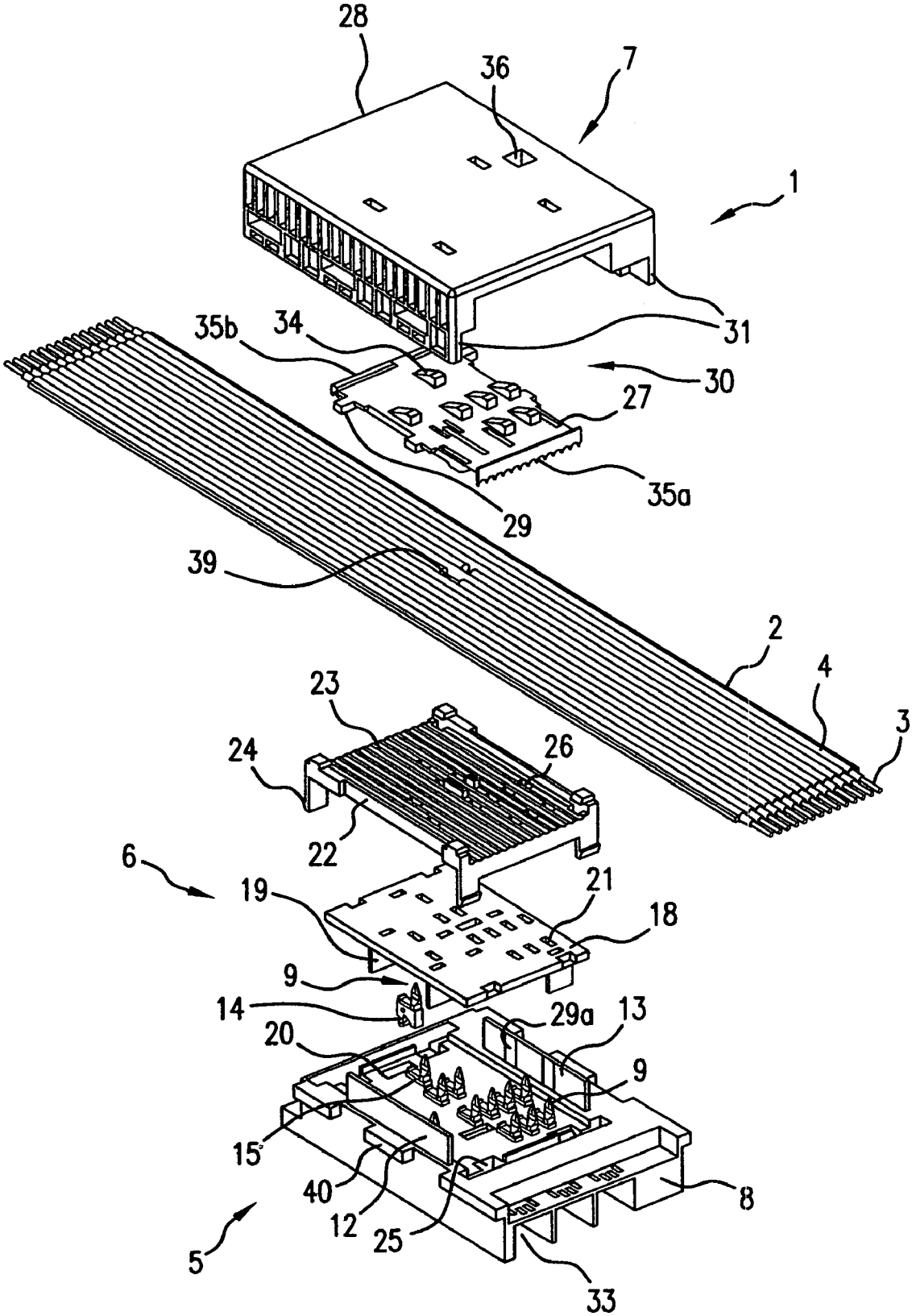
FIG. 1 is an exploded perspective view of the flat cable insulation-piercing connector arrangement of the present invention.

Referring first more particularly to FIG. 1, the connector arrangement 1 of the present invention is adapted for use with a flat cable 2 having a plurality of insulated conductors 3 that are enclosed in an outer casing 4. The connector arrangement includes housing means 5 having base means 6 for supporting the flat cable 2, and top cover means 7 for enclosing the area above the cable 2.

Figure 5A:
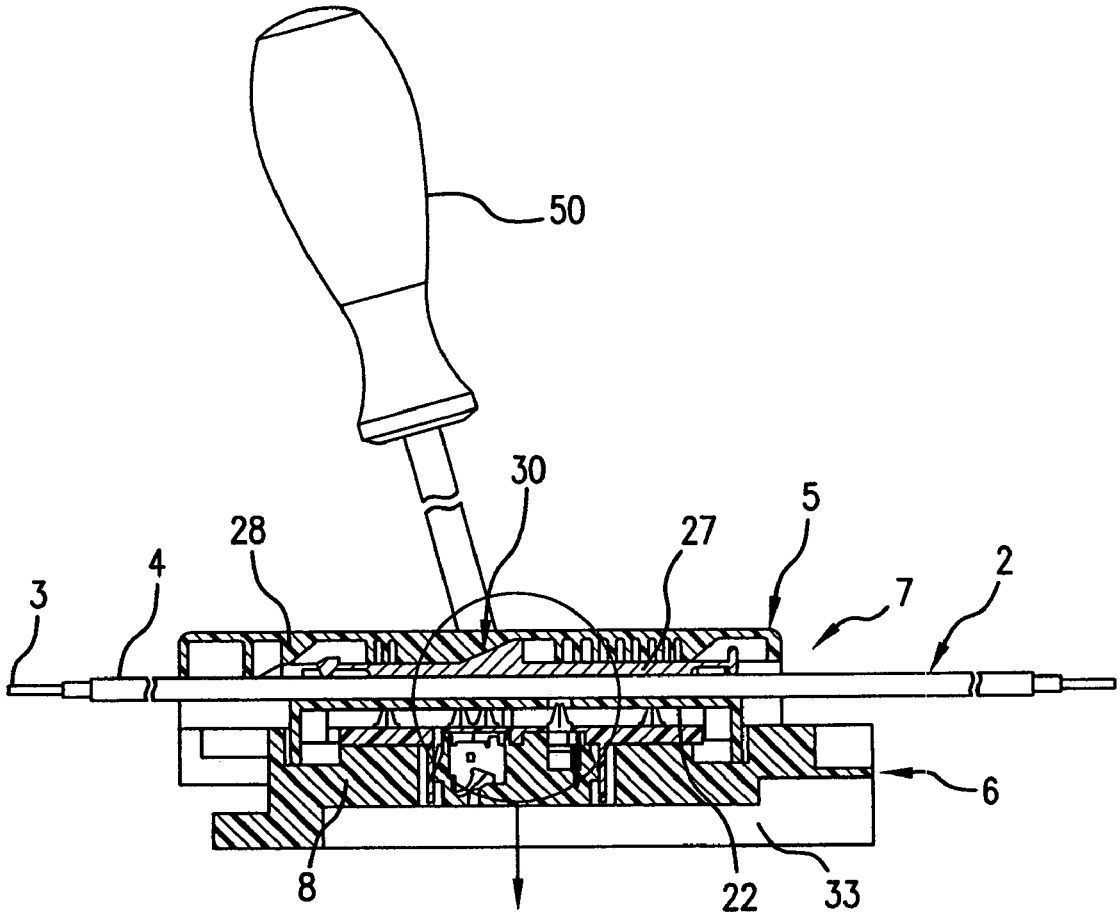
FIGS. 5*a* and 5*b*; 6*a* and 6*b*; and 7*a*, 7*b* and 7*c* are longitudinal sectional and detailed views of the connector arrangement with the cover member in the initial, intermediate and final positions relative to the housing base member, respectively.

The base means 6 includes a generally rectangular base member 8 formed from electrically-insulating synthetic plastic material and having a horizontal upper surface in which are mounted a plurality of upwardly-extending electrical contacts 9 that terminate at their upper extremities in knife edges 10 and 11 (FIG. 5). The contacts are stabilized by a stabilizing plate 18 that contains a plurality of slits 21 through which the contacts 9 extend. The contact stabilizing plate is fastened to the base member 8 by downwardly extending first catch means 19 that engage corresponding catch means 20 on the base member. Mounted above the contact stabilizing plate 18 is a horizontal support member 22 having a contoured upper surface 23 that corresponds with the adjacent surface of the flat cable 2. The cable support member 22 is arranged for vertical displacement relative to the base member 8 by means of downwardly extending guide legs 24 that engage in corresponding catch openings provided in the base member 8. Thus, the cable support plate 22 is operable to support the flat cable 2 longitudinally of the base member 8. The cable support plate contains a plurality of slits 26 that receive the contacts 9 when the cable support plate is in its lower position. Furthermore, the base plate 8 is provided with longitudinally-extending centering walls 12 and 13 also served to align the flat cable 2 in a longitudinal orientation relative to the base member 8.

In accordance with a characterizing feature of the invention, an actuator plate 27 is provided above the flat cable 2, which actuator plate is provided with laterally extending guide tabs 29 that extend within corresponding guide grooves 29*a* contained in the adjacent surfaces of the housing centering walls 12 and 13. The cover means 7 includes a cover member 28 that is connected for longitudinal sliding movement relative to the housing base member 8. As will be described in greater detail below, first wedge means 30 (FIG. 5) are provided between the actuator plate 27 and the lower surface of the cover member 28, which wedge means serve to force the flat cable 2 downwardly together with the cable support member 22 toward the contacts 9 that are supported by the base member 8, whereupon the knife edges 10 and 11 of the insulation-piercing contacts 9 sever the insulation layers of the associated conductor to electrically engage the conductor contained therein. The wedge means 30 include wedge members 34 carried by the upper surface of the actuator plate 27, and wedge members 32 (FIG. 5) carried by the lower surface of the cover member 28.

Figure 2:
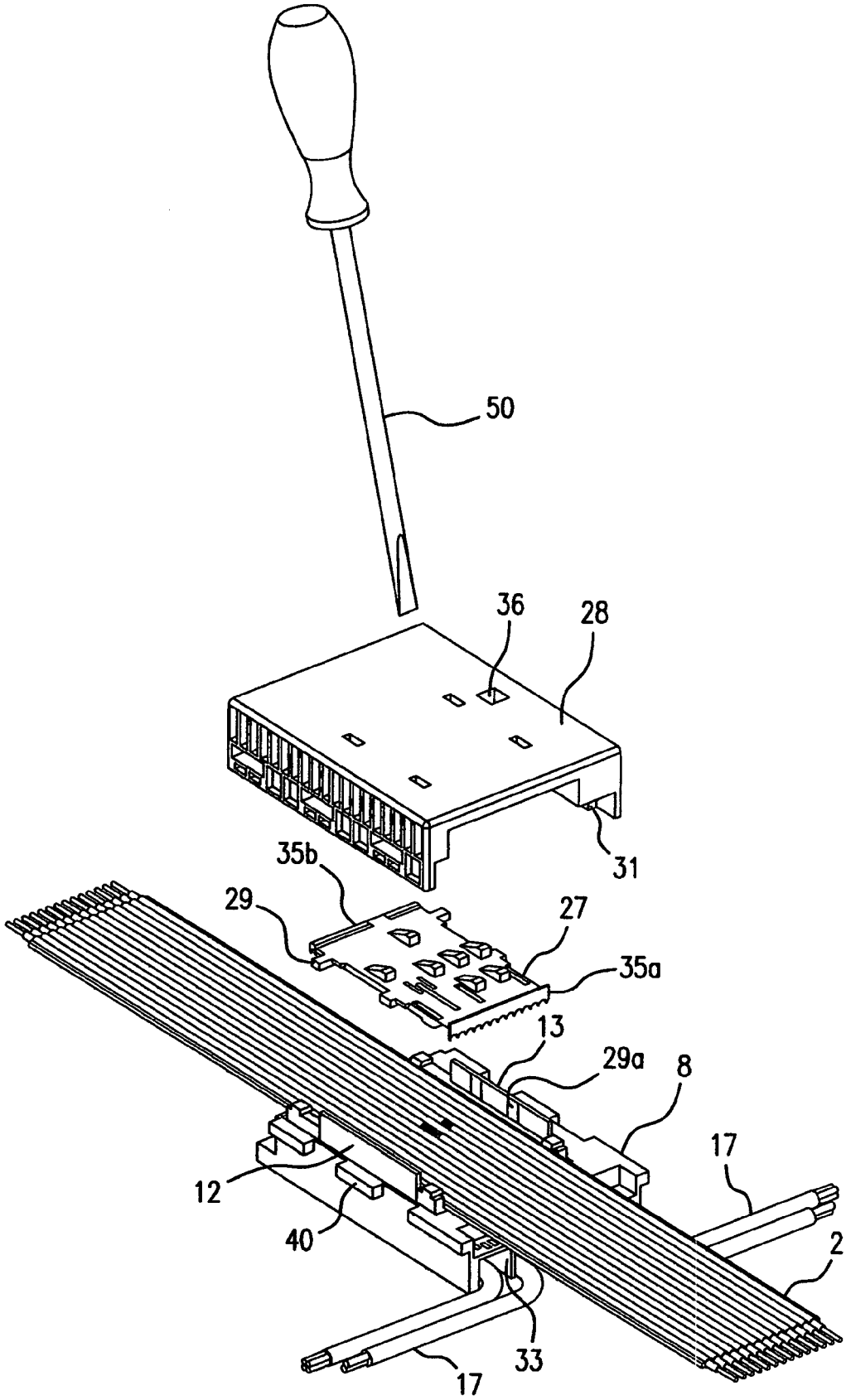
FIG. 2 is a partially exploded view illustrating an initial preparatory step for operating the connector device.
Figure 3:
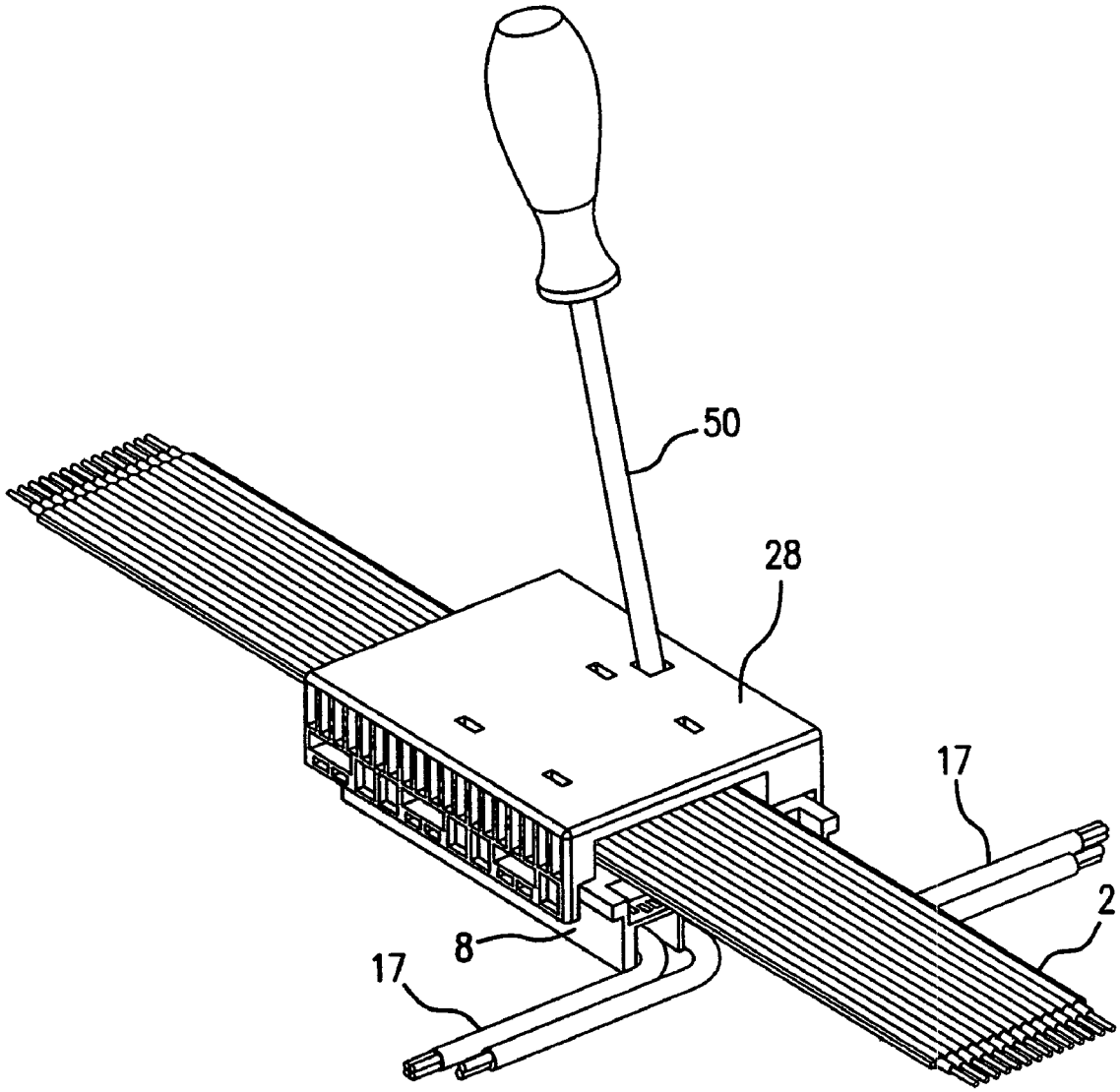
FIGS. 3 and 4 are perspective views illustrating the connector arrangement when in initial and intermediate conditions of operation, respectively.
Figure 4:
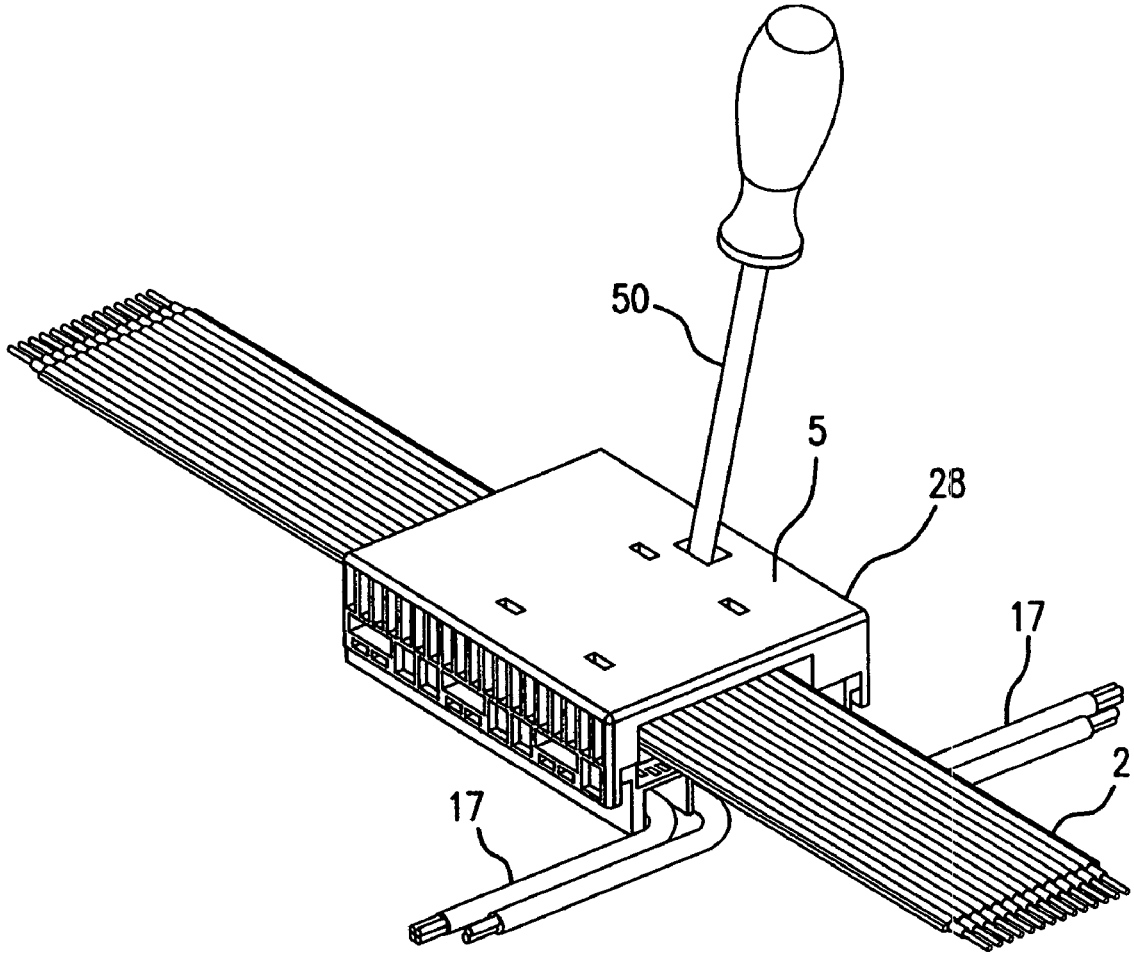

Referring now to FIG. 2, it will be seen that tap-off branch conductors 17 extend from channels 33 contained in the bottom surface of the base member 8. At one end the tap-off branch conductors 17 are connected with the corresponding insulation-piercing contacts 9 via resilient contact means 14 (FIG. 5), and the other ends of the branch conductors are connected with associated electrical equipment, not shown. During the assembly of the connector arrangement, the flat cable 2 is inserted longitudinally between the centering walls 12 and 13 of the base member 8, whereupon the actuating plate 27 is downwardly displaced in seated arrangement on the flat cable 2, as guided by the cooperation between the lateral guide tabs 29 on the actuator plate and the corresponding guide grooves 29*a* contained in the centering side walls. The cover member 28 is then longitudinally slidably connected with one end of the base member 8 by the cooperation between inwardly directed guide rails 31 (FIG. 8) on the lower ends of the side walls of the cover member 28 and the lateral guide tabs 40 on the base member 8. The cover member is displaced from the first end position adjacent the end of the base member 8 by operation of the screw driver 50 toward an intermediate position shown in FIG. 4.

Figure 5B:
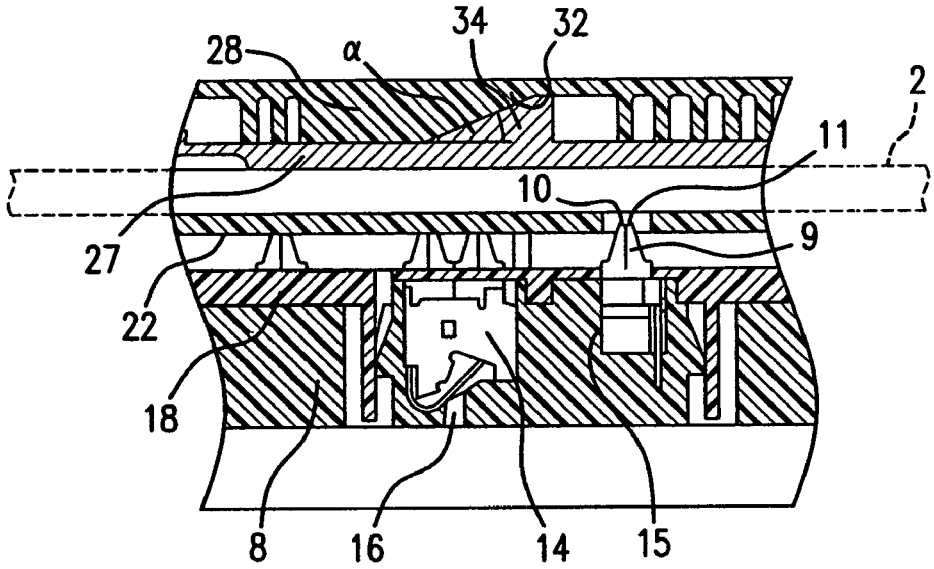

During this initial displacement of a cover member 28 toward the right, the cooperation between the inclined surfaces on the wedge members 32 carried by the cover member with the inclined surfaces on the wedge members 34 carried by the actuator plate 27 causes the actuator plate to be displaced downwardly toward the base member 8. The wedge surfaces between the first wedge members 32 and 34 have a common wedge angle a as shown in FIG. 5*b*. The cable 2 is supported by the cable support plate 22 at a position just above the knife edges 10 and 11 of the insulation-piercing contacts 9. The base member 8 contains chambers 15 in which are mounted the spring-biased contacts 14 that are electrically connected with the insulation-piercing contacts 9, respectively. The tap-off branch conductors 17 are connected at one end with the spring contacts 14 via openings 16 contained in the bottom portion of the base plate 8.

Figure 6A:
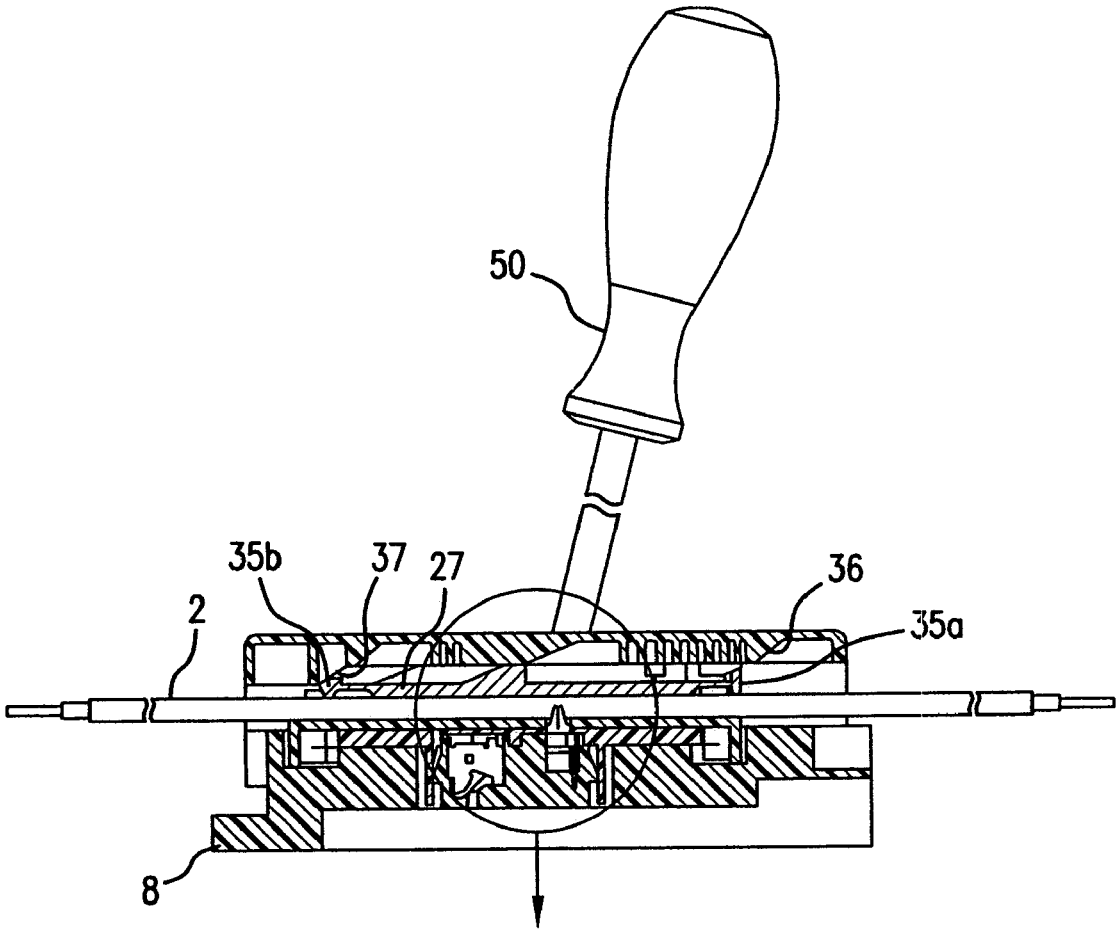
Figure 6B:
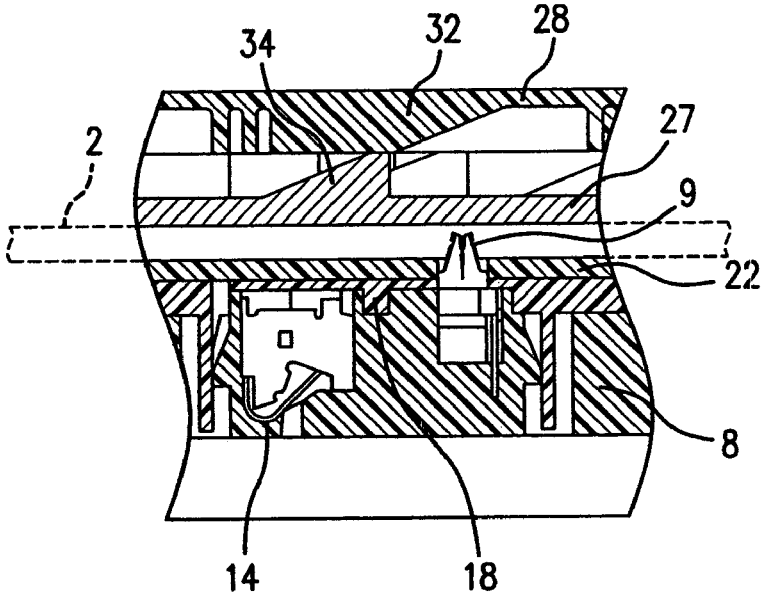

As the cover member 28 is slidably displaced to the right relative to the base member 8 toward the intermediate position of FIG. 6*a*, the cooperation between the wedge members 32 and 34 caused the actuator plate 27 to be displaced downwardly, thereby to cause the knife edges 10, 11 on the contacts 9 to pierce the insulation layers of the corresponding conductors on the flat cable 2. The contacts 9 are now electrically connected between the cable conductors 3 and the respective tap-off branch conductors 17.

Figure 7C:
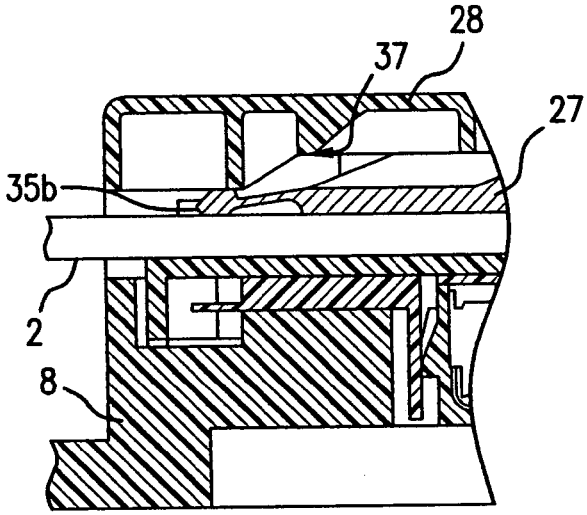
Figure 7A:
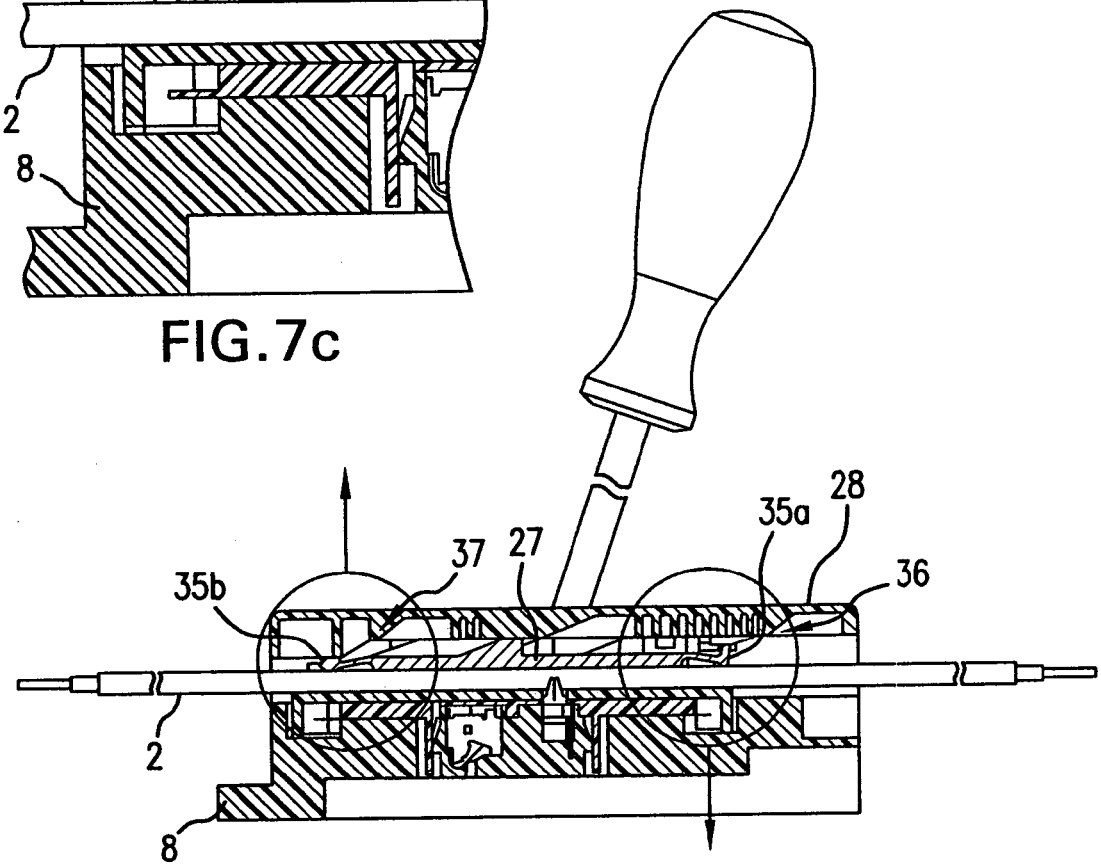
Figure 7B:
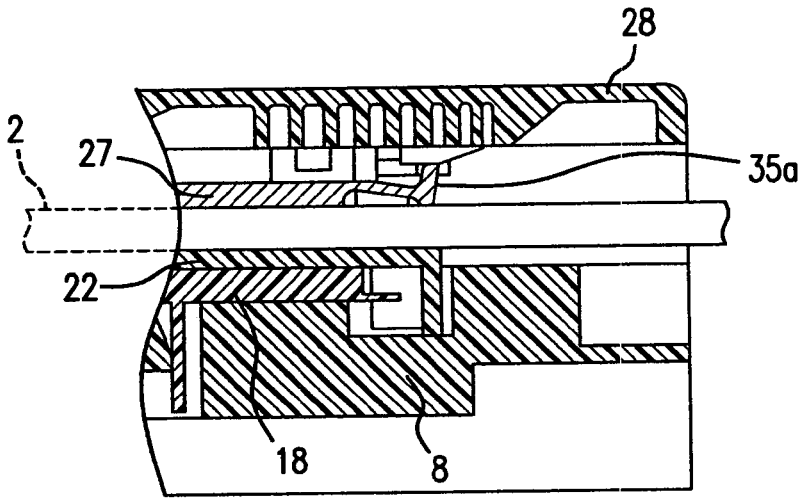

According to a characterizing feature of the invention, during further pivotal movement of the screw driver 50 toward the right, the cover member 28 is displaced to its final position (FIG. 7*a*) relative to the base member 8, thereby to cause second wedge means to displace the end portions 35*a* and 35*b* downwardly toward tight clamped positions relative to the flat cable 2. These second wedge means include a cover wedge member 36 at one end of the cover member that engages the flexible end portion 35*a* of the actuator plate 27, and a further cover wedge member 37 at the other end of the cover member 28 which engages a flexible portion 35*b* at the other end of the actuator plate 27. By clamping the end portions 35*a* and 35*b* of the actuator plate 27 to the adjacent surfaces of the flat cable 2, strain relief protection is provided that relieves the strain on the contacts 9 relative to the flat cable 2.

Figure 8:
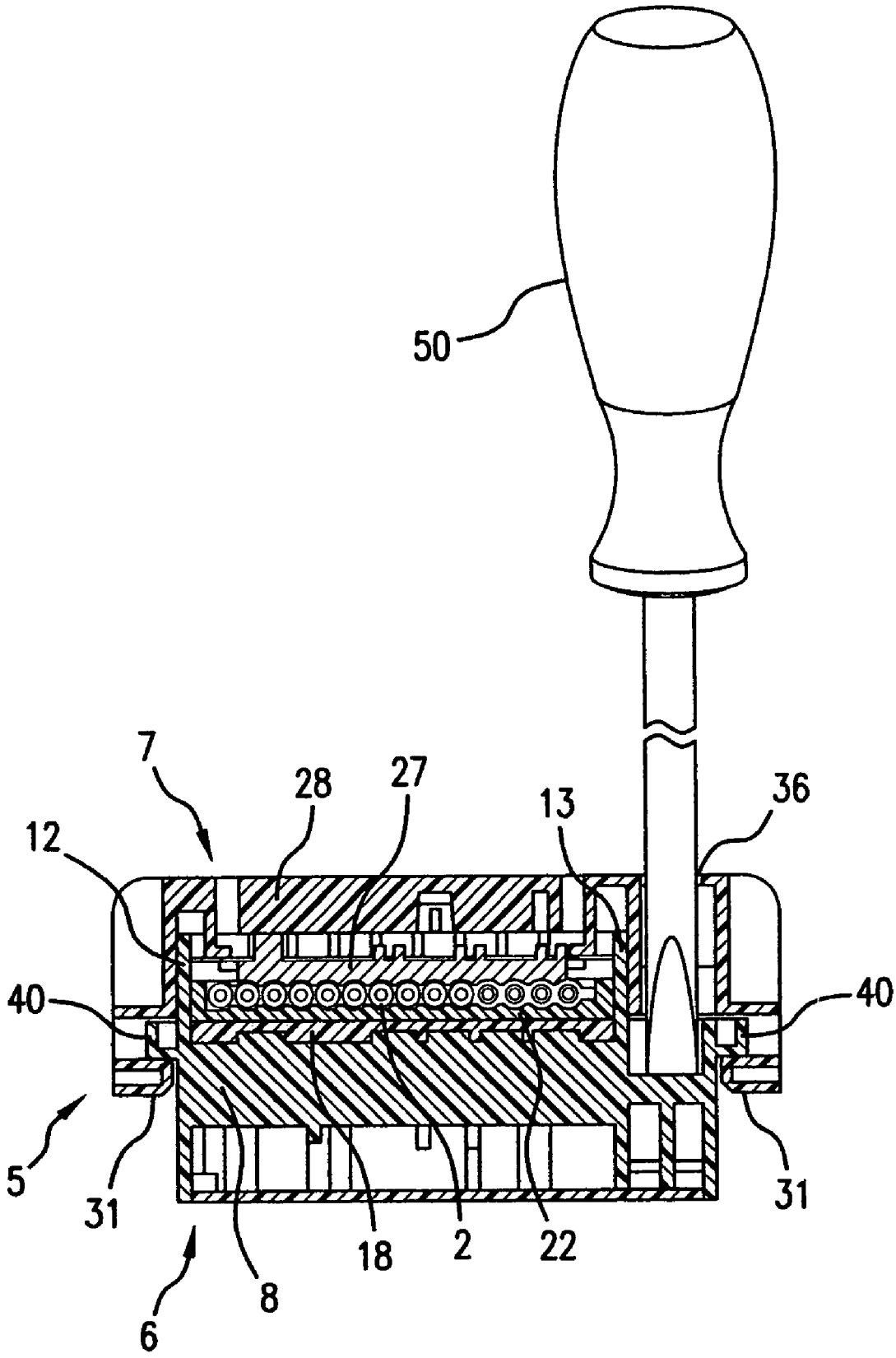
FIG. 8 is a transverse sectional view of the connector arrangement.

As shown in FIG. 8, the cover member 28 serves to maintain the actuator plate 27 in the downwardly displaced position relative to the flat cable 2, thereby to cause the contacts 9 to penetrate the outer casing 4 and the insulation layers of the conductors.

Figure 9A:
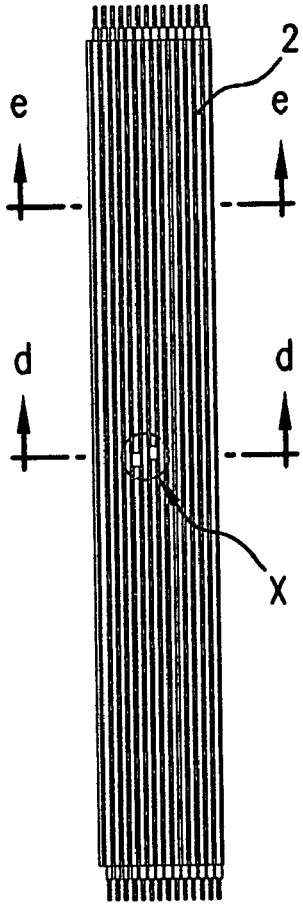
FIG. 9*a* is a plan view of one of the flat conductors used in connection with the invention; 9*b* is an enlarged detailed view of the portion X of the flat conductor of FIG. 9*a*.
Figure 9B:
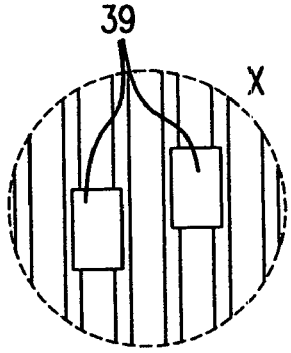
FIG. 9*c* is and end view of the flat conductor of FIG. 9*a*.
FIGS. 9*d* and 9*e* are sectional views taken along lines d-d and e-e of FIG. 9*a*.
Figure 9C:
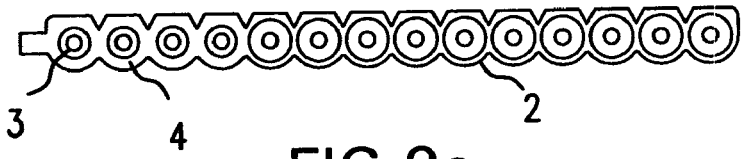
Figure 9D:
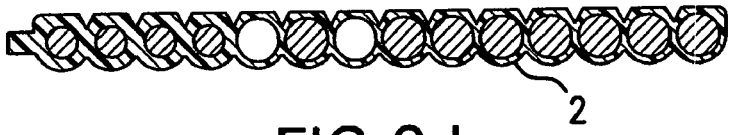
Figure 9E:
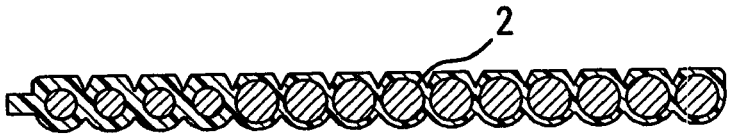
Figure 10A:
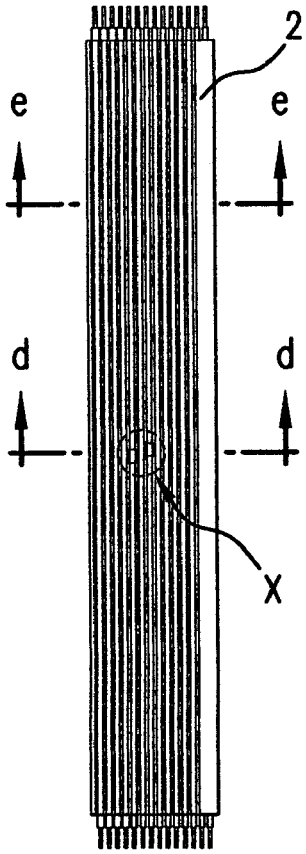
FIG. 10*a* is a plan view of a second flat cable embodiment.
Figure 10F:
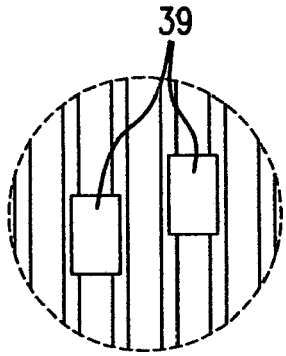
FIG. 10*b* is a corresponding view with certain parts broken away.
FIG. 10*c* is an end view of the flat cable of FIG. 10*a*.
FIGS. 10*d* and 10*e* are sectional views taken along lines d-d and e-e, respectively, of FIG. 10*a*; and 10*f* is a detained view of the circled portion X of FIG. 10*a*.
Figure 10B:
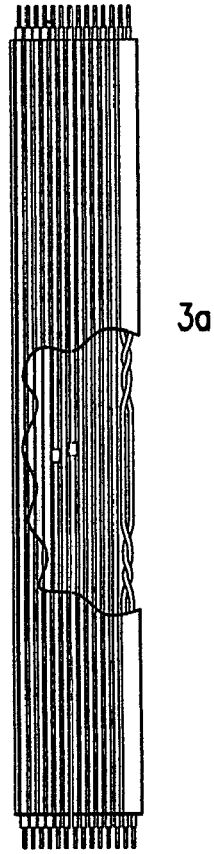
Figure 10C:
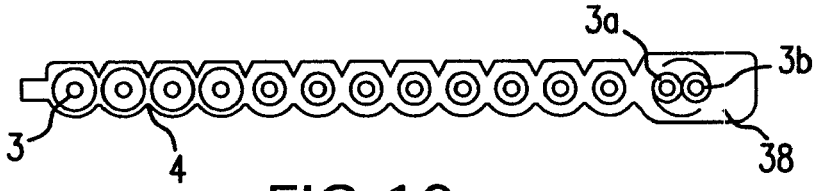
Figure 10D:
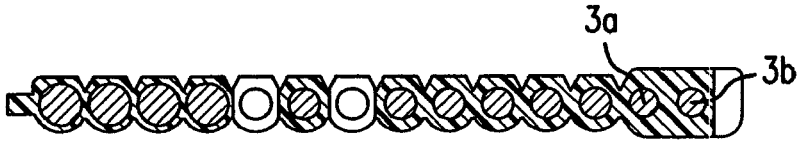
Figure 10E:
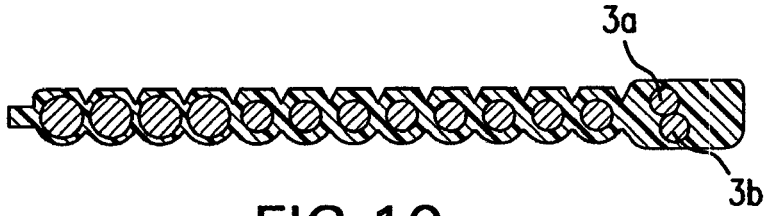

Referring now to FIG. 9*a*, a typical flat cable 2 may be provided with segmented severed portions 39, thereby to define in those conductors end portions that may be connected by the contacts 9 with associated electrical apparatus (not shown). Furthermore, as shown in FIG. 10, the outermost conductors 3*a* and 3*b* may be twisted together, thereby to define on the flat cable an enlarged widened coding area 38.

The cover member 28 and the actuator plate 27 are formed from metal or a hard synthetic plastic material. The clamping end portions of the actuator plate are preferably flexibly connected with the main body portion of the actuator plate. The support member 22, the stabilizing plate 18 and the base member 8 are formed from a suitable electrically insulating synthetic plastic material.

While in accordance with the provisions of the Patent Statutes the preferred forms and embodiments of the invention have been illustrated and described, it will be apparent to those skilled in the art that changes may be made without deviating from the invention described above.

What is claimed is:

1. A connector arrangement for connecting an insulated conductor (3) of a flat multi-conductor cable (2) with a tapped-off branch conductor (17), comprising:

(a) housing base means (6) including a generally rectangular base member (8) having a longitudinal axis and a horizontal upper surface;

(b) a plurality of insulation-piercing electrical contacts (9) carried by said base member and extending upwardly from said base upper surface, the upper extremities of said contacts having knife edges (10, 11);

(c) cable support means for supporting the flat cable for vertical displacement relative to said base means with the conductors of the cable positioned above said contacts, respectively, said cable support means containing openings (21) opposite said contacts:

(d) a horizontal actuator plate (27) connected with said base member above said cable support means for displacement between an upper position spaced above said contacts toward a lower position adjacent said contacts, the spacing distance between said actuator plate and said contacts being greater than the thickness of the flat cable, thereby to permit the longitudinal horizontal introduction of the flat cable between said actuator plate and said contacts with the conductors of the cables being arranged above the contacts, respectively;

(e) displacing means for displacing said actuator plate downwardly to press the cable conductors into insulation-piercing engagement with the associated respective contacts, including:

(1) a housing cover member (28) arranged horizontally above and spaced from said actuator plate;

(2) engaging means (31, 40) connecting said cover member with said base member for longitudinal sliding displacement relative to said base member between a first position partially displaced from said base member and a second position over said base member;

(3) first wedge means (30) arranged between said actuator plate and said cover member, said first wedge means being operable by said actuator plate during the initial displacement of said cover member from said first position toward said second position to displace the cable downwardly into insulation-piercing engagement with said contact knife edges; and (f) a plurality of branch conductors (17) connected with said contacts, respectively.

2. A connector arrangement as defined in claim 1, wherein said actuator plate has longitudinally spaced end portions including cable retaining means (35*a* and 35*b*); and further including:

(g) second wedge means (36, 37) arranged between said cover member and said actuator plate for operation during the final displacement of said cover member toward said second position for clamping said cable retaining means into strain-relieving protective engagement with the cable.

3. A connector arrangement as defined in claim 2, and further including:

(h) centering means for centering the flat conductor longitudinally of said base member.

4. A connector arrangement as defined in claim 3, wherein said centering means includes a pair of parallel spaced longitudinally-extending side walls (12, 13) extending upwardly from said base member upper surface.

5. A connector arrangement as defined in claim 3, and further including:

(i) contact stabilizing means, including a horizontal contact stabilizing plate (18) mounted on said base member, said stabilizing plate containing a plurality of slits (21) through which said contacts upwardly extend, respectively.

6. A connector arrangement as defined in claim 5, and further including catch means (19, 20) connecting said stabilizing plate with said base member.

7. A connector arrangement as defined in claim 2, and further including resilient contact means (14) for connecting said insulation-piercing contacts with said branch conductors, respectively.

8. A connector arrangement as defined in claim 7, wherein said base member upper surface contains a plurality of chambers (15) in which said resilient contacts are mounted.

9. A connector arrangement as defined in claim 8, wherein said base member has a bottom wall containing a plurality of longitudinal channels communicating with said chambers, said tap-off branch conductors being arranged in said channels, respectively.

10. A connector arrangement as defined in claim 9, wherein said electrical contacts are arranged in longitudinally staggered relation relative to said base member.

11. A connector arrangement as defined in claim 2, wherein said cable retaining means comprises flexible enlarged projections (35*a*, 35*b*) arranged at the longitudinally spaced ends of said actuator member.

12. A connector arrangement as defined in claim 1 wherein said cable support means comprises:

(1) a horizontal rectangular support member (22) having a contoured upper surface (23) corresponding with the contoured surface of the flat cable; and (2) guide means (24) guiding said support member for vertical displacement between an upper position spaced from said contacts, and a lower position in which the contacts extend upwardly through corresponding slits (21) contained in said support member, respectively.

13. A connector arrangement as defined in claim 1, wherein said first wedge means includes cover wedge members (32) arranged on the bottom surface of said cover member for cooperation with associated actuating wedge members (34) arranged on the upper surface of said actuator plate.

14. A connector arrangement as defined in claim 13, wherein said cover wedge members and said actuator wedge members have wedge surfaces arranged at a common wedge angle (a).

15. A connector arrangement as defined in claim 1, and further including a flat cable (2) having a plurality of insulated conductors (3) enclosed in an outer casing (4), at least two of said conductors having severed segment portions (39); and further wherein a plurality of said insulation contacts connect the ends of the severed conductors with an electrical device.

16. A connector arrangement as defined in claim 15, and further wherein at least two of said conductors (2*a*, 2*b*) adjacent one side of said flat cable are twisted to define a widened coding area (38).

* * * * *